US007958822B2

(12) United States Patent
Sims

(10) Patent No.: US 7,958,822 B2
(45) Date of Patent: Jun. 14, 2011

(54) METHOD FOR FORMING AN IMAGE IN STONE

(76) Inventor: Timothy Andrew Sims, Dunedin, FL (US)

( * ) Notice: Subject to any disclaimer, the term of this patent is extended or adjusted under 35 U.S.C. 154(b) by 765 days.

(21) Appl. No.: 11/867,442

(22) Filed: Oct. 4, 2007

(65) Prior Publication Data

US 2009/0090262 A1 Apr. 9, 2009

(51) Int. Cl.
*B44C 1/175* (2006.01)

(52) U.S. Cl. ..... 101/492; 156/230; 428/914

(58) Field of Classification Search ..... None
See application file for complete search history.

(56) References Cited

U.S. PATENT DOCUMENTS

| | | | | |
|---|---|---|---|---|
| 5,916,662 | A | 6/1999 | Schmidt | |
| 6,161,554 | A * | 12/2000 | Dunlap-Harris | 132/216 |
| 6,569,277 | B1 | 5/2003 | Gibbs | |
| 6,686,315 | B1 | 2/2004 | Creed | |
| 7,108,890 | B2 | 9/2006 | Horne et al. | |

* cited by examiner

*Primary Examiner* — Joshua D Zimmerman
(74) *Attorney, Agent, or Firm* — Larson & Larson, P.A.; Frank Liebenow; Justin Miller

(57) ABSTRACT

An application for a method of imbedding an image in a stone substrate includes printing an image onto a print image using a computer printer and placing the print image face down on the surface of the stone substrate. A moist towel is placed over the print image and a weight is placed over the moist towel then time is provided for the image to transfer from the print image to the surface of the stone substrate. The moist towel and the print image are then removed and the above steps are repeated until a quality image is imbedded in the stone substrate.

20 Claims, 4 Drawing Sheets

METHOD FOR FORMING AN IMAGE IN STONE

FIELD OF THE INVENTION

This invention relates to the formation of images in porous solid materials and more particularly to a method and apparatus for forming an image in a sheet of stone.

BACKGROUND OF THE INVENTION

Stone such as marble and granite are used for many purposes including counter tops, door sills, decorative inlays and the like. For many applications, the natural colors and random patterns are desired for aesthetic reasons.

In some applications, it is desired to impregnate the natural stone with a design or image. Such applications include decorative replacements for stained glass and photographic images in monuments, etc. Prior attempts at such have produced limited results with superficial images that wear with time.

Some prior art includes methods of printing on stone. For example, U.S. Pat. No. 5,916,662 to Schmidt shows how to print on a coating on the stone. Unfortunately, the coating covers the stone and detracts from the aesthetic appeal of the stone and the coating can separate from the stone.

U.S. Pat. No. 6,569,277 to Gibbs shows how to transfer an image onto the surface of a material including a leaf and stone. Unfortunately, placing the image on the surface results in an image that is easily scratched.

U.S. Pat. No. 6,686,315 to Creed has a method of making a building material that simulates the look of marble or granite that may include lettering, etc. This method uses a coated substrate as in U.S. Pat. No. 5,916,662 and, therefore, does not present natural stone to the viewer.

U.S. Pat. No. 7,108,890 to Horne, et al, also requires a coating or matrix to be applied to the stone before introducing the image and, therefore, does not present natural stone to the viewer.

What is needed is a method of impregnating a stone material with an image that will augment the natural beauty of the stone with an indelible image.

SUMMARY OF THE INVENTION

In one embodiment, a method of imbedding an image in a stone substrate is disclosed including printing an image onto a print image using a computer printer and placing the print image face down on the surface of the stone substrate. A moist towel is placed over the print image and a weight is placed over the moist towel then time is provided for the image to transfer from the print image to the surface of the stone substrate. The moist towel and the print image are then removed and the above steps are repeated until a quality image is imbedded in the stone substrate.

In another embodiment, a method of imbedding an image in a stone substrate is disclosed including sanding the surface of the stone substrate. An image is printed onto a print image using a computer printer and placed on a surface of the stone substrate. A moist white towel is placed over the print image and a weight is placed over the white moist towel. An opposing surface of the stone substrate is evacuated while providing time for the image to transfer from the print image to the surface of the stone substrate. After enough time lapses, the white moist towel and the print image are removed. These steps are repeated until a quality image is imbedded in the stone substrate.

In another embodiment, method of imbedding an image in a sheet of Thasos Greek Marble is disclosed including (a) sanding a surface of the sheet of Thasos Greek Marble. (b) Printing an image onto a print image using a computer printer. Next, (c) placing the print image on a surface of the sheet of Thasos Greek Marble then (d) placing a moist white towel over the print image and (e) placing a weight over the white moist towel. While the image is being absorbed into the sheet of Thasos Greek Marble, (f) evacuating an opposing surface of the sheet of Thasos Greek Marble and (g) providing time for the image to transfer from the print image to the surface of the sheet of Thasos Greek Marble. After the time is finished, (h) removing the white moist towel and the print image the (i) repeating steps a-h until a quality image is imbedded in the stone substrate.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
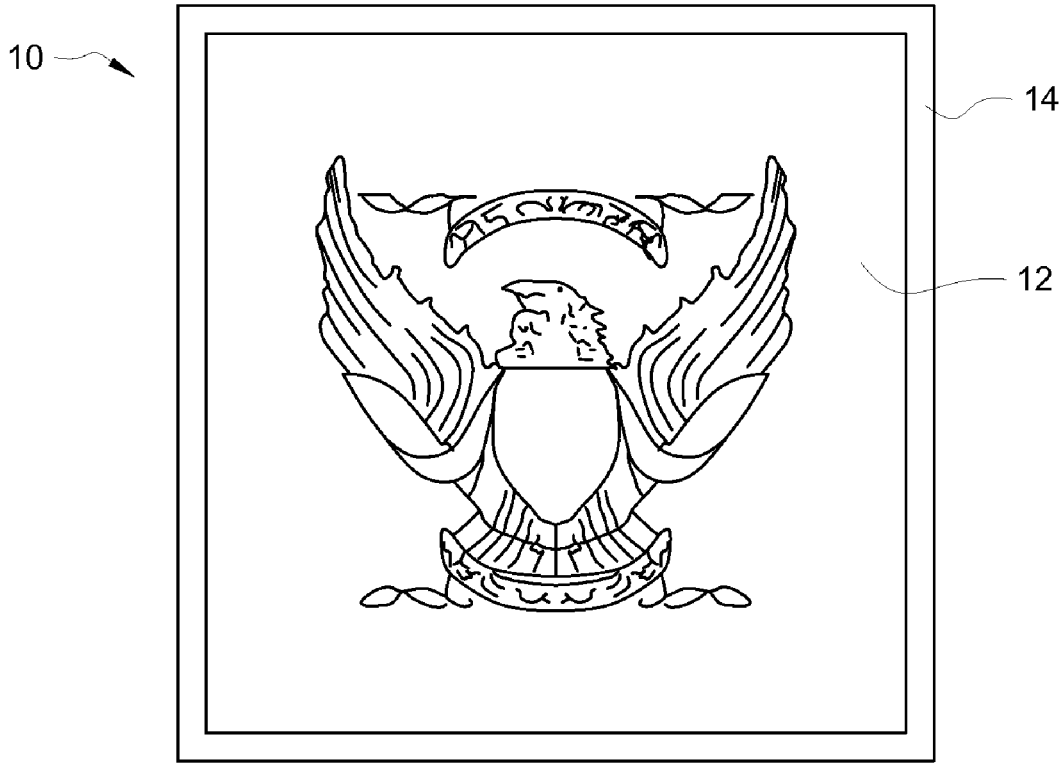
FIG. 1 illustrates an image to be imbedded into a stone substrate of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a front plan view of a printed image 10 to be imbedded into a stone substrate 20 is shown. In some embodiments, the image has a border area 14 where no image is present, usually white.

Figure 2:
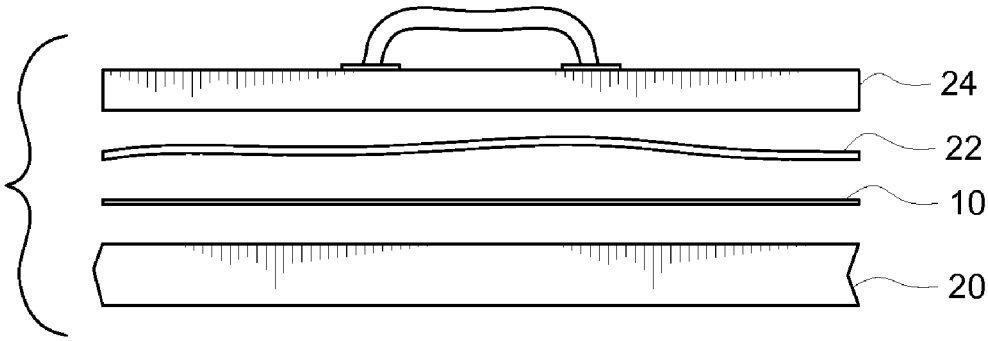
FIG. 2 illustrates a side view of the layers used in creating an image in stone of a first embodiment of the present invention.

Referring to FIG. 2, a side view of the layers used in creating an image in stone of a first embodiment of the present invention is shown. To create an image in a stone substrate 20, one or more repetitions of the following steps are performed until the image 12 is imbedded in the stone substrate 20, being visible from both sides. The steps include printing an image using a computer printer and placing the image 10 face down on the on the substrate 20, placing a moistened towel 22 completely covering the image 10 and placing a planar weight 24 over the moistened towel 22. The image 10, moistened towel 22 and planar weight 24 are left on the stone substrate 20 for a period of time to allow inks from the printed image to leach into the stone substrate 20. In some embodiments, the image 10, moistened towel 22 and planar weight 24 is left on the stone substrate 20 for from eight to twelve hours. Once the time period is finished, the image 10, moistened towel 22 and planar weight are removed from the stone substrate 20 and the steps repeated as needed using a new printed image 10. In some embodiments, the stone substrate 20 is sanded each time, before applying the image. The grit of the sandpaper is increased (finer) each successive iteration of the method. For example, before the first image is imbedded, a 36-grit cup wheel is used to slightly texture the stone substrate 20. Before the second image is imbedded, 30-grit sandpaper is used to begin to polish the stone substrate 20. Before the third image is imbedded, 50-grit sandpaper is used to further polish the stone substrate 20, and so fourth. It is preferred to use diamond sand paper. It is preferred that the moistened towel be a white towel so as to not introduce any dyes during the image transfer.

The stone substrate 20 is preferably a planar substrate of stone such as marble or granite. A preferred stone substrate 20 is marble. A preferred marble is white Thasos Greek marble. Although the present invention works well on many varieties of stone substrates 20, it has been found that pale white Thasos Greek marble performs best. The image 12 is formed throughout the stone substrate 20; therefore, it is visible from the front side of the stone substrate 20 as well as from the back side of the stone substrate 20, one side being the mirror opposite of the other.

Figure 3:
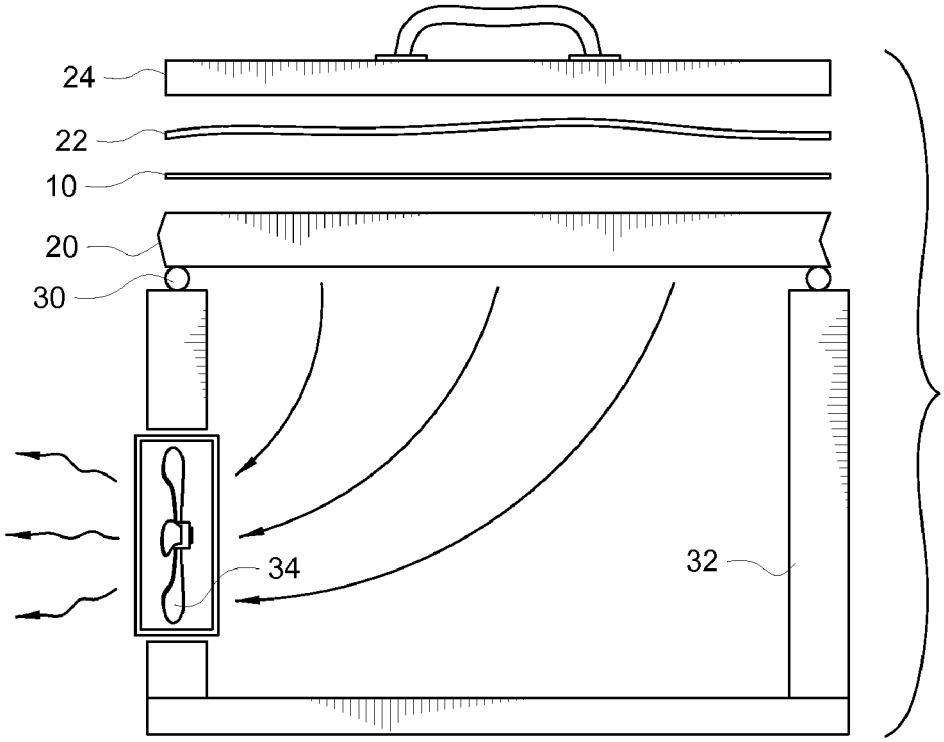
FIG. 3 illustrates a side view of the layers used in creating an image in stone of a second embodiment of the present invention.

Referring to FIG. 3, a side view of the layers used in creating an image in stone of a second embodiment of the present invention is shown. In this embodiment, a source of negative air pressure is provided to urge inks from the printed image 10 through the stone substrate 20. To create an image in a stone substrate 20, one or more repetitions of the following steps are performed until the image 12 is imbedded in the stone substrate 20, being visible from both sides. The steps include placing the stone substrate 20 on a negative pressure table 32, placing the image 10 face down on the on the substrate 20, placing a moistened towel 22 completely covering the image 10 and placing a planar weight 24 over the moistened towel 22. The stone substrate 20 is left with the image 10, moistened towel 22 and planar weight 24 for a period of time to allow inks from the printed image to leach into the stone substrate 20. In some embodiments, the stone substrate 20 is left with the image 10, moistened towel 22 and planar weight 24 for from eight to twelve hours. Once the time period is finished, the image 10, moistened towel 22 and planar weight are removed from the stone substrate 20 and the steps repeated as needed using a new printed image 10.

The negative pressure table 32 is a source of negative pressure to urge inks from the printed image 10 through the stone substrate 20. In the example shown, the negative pressure (vacuum) table 32 has a fan 34 for evacuating air from beneath the stone substrate 20. In some embodiments, a gasket 30 is provided to prevent air from leaking in between the stone substrate 20 and the negative pressure table 32.

Figure 4:
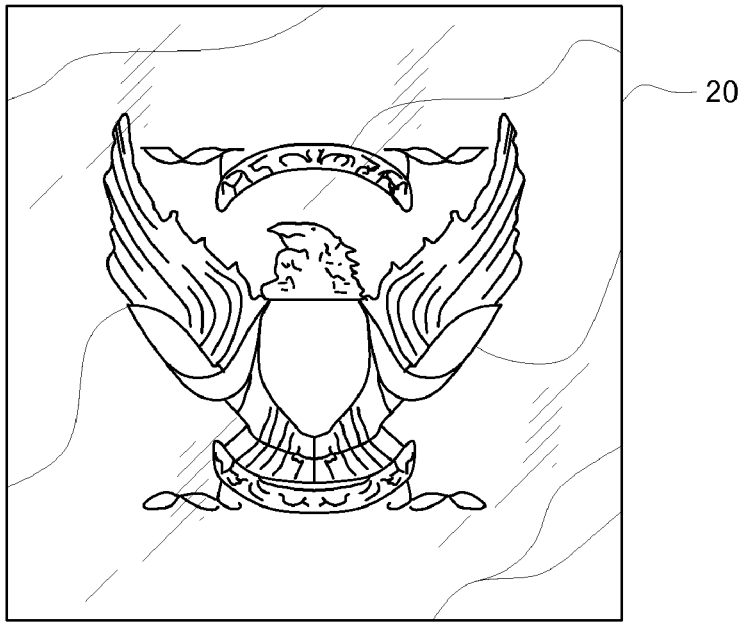
FIG. 4 illustrates a plan view of a finished image in stone of the present invention.

Referring to FIG. 4, a plan view of a finished image in stone of the present invention is shown. In some embodiments, the printed image 10 is printed as a mirror copy of the final image so that when it is transferred to the stone substrate 20, it appears as the image was intended. In other embodiments, the printed image 10 is printed as a direct copy of the final image so that when it is transferred to the stone substrate 20, it appears as a mirror copy of the final image, but since the image is imbedded in the stone substrate 20, it is visible from the opposite side of the stone substrate 20. Since the image is imbedded within the stone substrate 20, it is possible to polish, sand, grind, sand blast, texture, etc.; the stone substrate without damaging or loosing the image.

Figure 5:
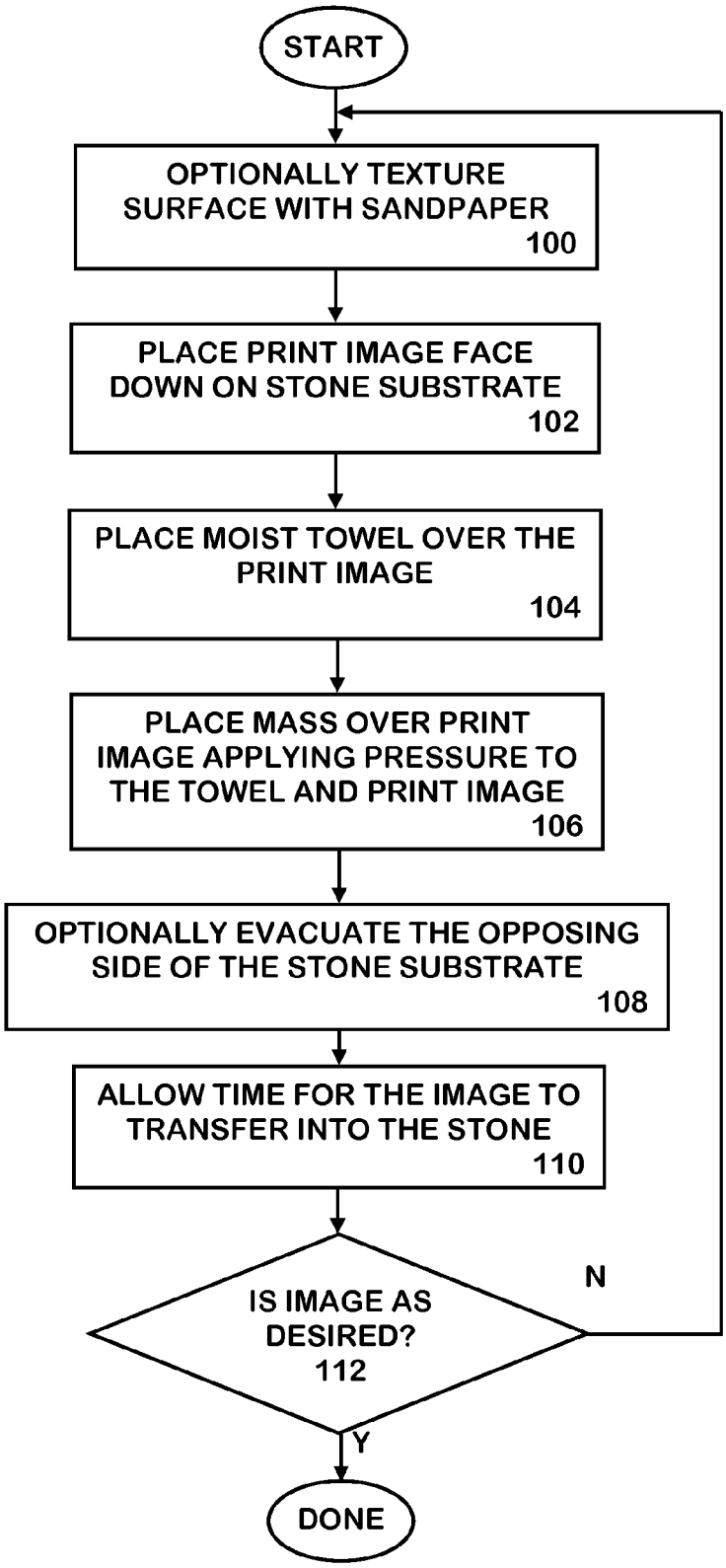
FIG. 5 illustrates a flow chart of a method of imbedding an image in stone of the present invention.

Referring to FIG. 5, a flow chart of a method of imbedding an image in stone of the present invention is shown. The first step in creating an image in a stone substrate 20 is to texture 100 the stone substrate 20, preferable with diamond sandpaper. In some embodiments, this step is omitted. The next step is to place a printed image face down 102 on the on the substrate 20. Next, a moistened towel 22 is placed completely covering the image 10. Next, a mass or planar weight 24 is placed 106 over the moistened towel 22. In some embodiments, the steps include evacuating 108 the opposing side of the stone substrate 20, in some embodiments placing the stone substrate 20 on a negative pressure table 32. The image 10, moistened towel 22 and planar weight 24 are left on stone substrate 20 for a period of time 110 to allow inks from the printed image to leach into the stone substrate 20. In some embodiments, the image 10, moistened towel 22 and planar weight 24 are left on the stone substrate 20 for from eight to twelve hours. Once the time period is finished, the image 10, moistened towel 22 and planar weight are removed from the stone substrate 20 and if the image is not yet as clear as desired 112, the steps are repeated as needed using a new printed image 10. It is preferred to repeat the steps with as little time between repetitions so as to preclude the inks from the print image from drying before the next repetition.

Figure 6:
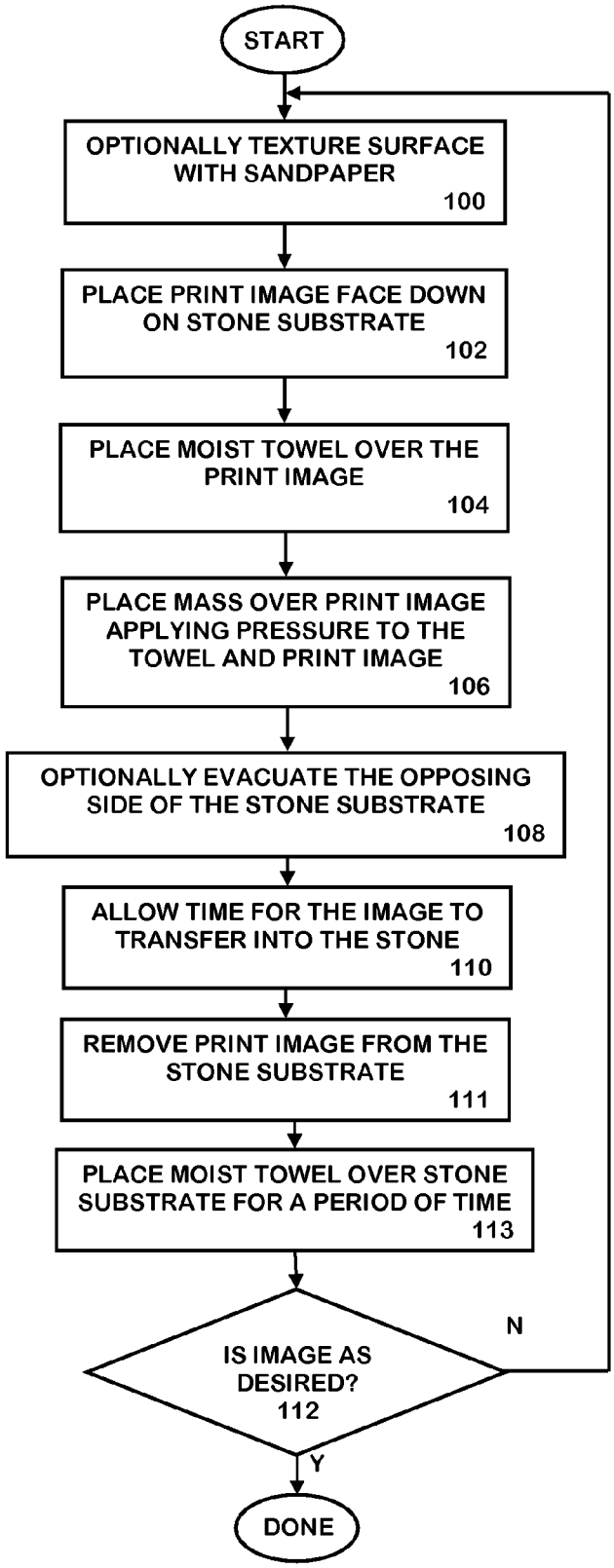
FIG. 6 illustrates a second flow chart of a method of imbedding an image in stone of the present invention.

Referring to FIG. 6, a second flow chart of a method of imbedding an image in stone of the present invention is shown. The first step in creating an image in a stone substrate 20 is to texture 100 the stone substrate 20, preferable with diamond sandpaper. In some embodiments, this step is omitted. The next step is to place a printed image face down 102 on the on the substrate 20. Next, a moistened towel 22 is placed completely covering the image 10. Next, a mass or planar weight 24 is placed 106 over the moistened towel 22. In some embodiments, the steps include evacuating 108 the opposing side of the stone substrate 20, in some embodiments placing the stone substrate 20 on a negative pressure table 32. The image 10, moistened towel 22 and planar weight 24 are left on stone substrate 20 for a period of time 110 to allow inks from the printed image to leach into the stone substrate 20. In some embodiments, the image 10, moistened towel 22 and planar weight 24 are left on the stone substrate 20 for from eight to twelve hours. Once the time period is finished, the image 10, moistened towel 22 and planar weight are removed 111 from the stone substrate 20 and the moistened towel 22 is placed over the stone substrate 20 and the planar weight 24 is placed over the moistened towel 22 for a period of time 113. Once the planar weight 24 and moist towel 22 is removed, the image is viewed and if the image is not yet as clear as desired 112, the steps are repeated as needed using a new printed image 10. It is preferred to repeat the steps with as little time between repetitions so as to preclude the inks from the print image from drying before the next repetition.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of imbedding an image in a stone substrate, the method comprising:

(a) creating a printed image;

(b) placing the printed image on a surface of a stone substrate;

(c) placing a moist towel over the printed image;
(d) placing a weight over the moist towel;
(e) providing time for the image to transfer from the printed image into the stone substrate;
(f) removing the moist towel and the printed image;
(g) repeating steps a-f at least once until a quality image is imbedded in the stone substrate, the quality image being visible from the opposite side.

2. The method of claim 1, wherein the time is 8 to 12 hours.

3. The method of claim 1, wherein the stone substrate is a planar sheet of marble.

4. The method of claim 3, wherein the marble is white Thasos Greek marble.

5. The method of claim 1, step (e) further comprises the step of evacuating an opposing surface of the stone substrate.

6. The method of claim 5, wherein the step of evacuating is performed by placing the stone substrate on a box having an open side where the stone substrate interfaces with the box, the box being sealed, the box having an opening interfaced to a fan for performing the evacuating.

7. The method of claim 1, wherein the towel is a white towel.

8. The method of claim 1, further comprising the step (x) of sanding the surface of the stone before step (a).

9. The method of claim 8, wherein the step of sanding uses finer grain sandpaper each time step (x) is performed.

10. A method of imbedding an image in a stone substrate, the method comprising:
(a) sanding a surface of a stone substrate;
(b) creating a printed image;
(c) placing the printed image on a surface of the stone substrate;
(d) placing a moist white towel over the printed image;
(e) placing a weight over the white moist towel;
(f) evacuating an opposing surface of the stone substrate;
(g) providing time for the image to transfer from the printed image into the stone substrate;
(h) removing the white moist towel and the printed image;
(i) repeating steps a-h at least once until a quality image is imbedded in the stone substrate, the quality image being visible from the opposite side.

11. The method of claim 10, wherein the time is 8 to 12 hours.

12. The method of claim 10, wherein the stone substrate is a planar sheet of marble.

13. The method of claim 12, wherein the marble is white Thasos Greek marble.

14. The method of claim 10, wherein the step of evacuating is performed by placing the stone substrate on a box having an open side where the stone substrate interfaces with the box, the box being sealed, the box having an opening interfaced to a fan for performing the evacuating.

15. The method of claim 10, wherein the step of sanding uses finer grain sandpaper each time step (a) is performed.

16. A method of imbedding an image in a sheet of Thasos Greek Marble, the method comprising:
(a) sanding a surface of the sheet of Thasos Greek Marble;
(b) creating a printed image;
(c) placing the printed image on a surface of the sheet of Thasos Greek Marble;
(d) placing a moist white towel over the printed image;
(e) placing a weight over the white moist towel;
(f) evacuating an opposing surface of the sheet of Thasos Greek Marble;
(g) providing time for the image to transfer from the printed image into the sheet of Thasos Greek Marble;
(h) removing the white moist towel and the printed image;
(i) repeating steps a-h at least once until a quality image is imbedded in the sheet of Thasos Greek Marble, the quality image being visible from the opposite side.

17. The method of claim 16, wherein the time is 8 to 12 hours.

18. The method of claim 16, wherein the sheet of Thasos Greek Marble is a planar sheet of Thasos Greek Marble.

19. The method of claim 16, wherein the step of evacuating is performed by placing the sheet of Thasos Greek Marble on a box having an open side where the sheet of Thasos Greek Marble interfaces with the box, the box being sealed, the box having an opening interfaced to a fan for performing the evacuating.

20. The method of claim 16, wherein the step of sanding uses finer grain sandpaper each time step (a) is performed.

* * * * *